United States Patent [19]

Jackson

[11] Patent Number: 4,841,868

[45] Date of Patent: Jun. 27, 1989

[54] COMPOSITE LONG ROD PENETRATOR

[75] Inventor: Raymond P. Jackson, West Chester, Pa.

[73] Assignee: The United States of America as represented by the Secretary of The Army, Washington, D.C.

[21] Appl. No.: 215,695

[22] Filed: Jun. 30, 1988

[51] Int. Cl.[4] ..... F42B 11/14

[52] U.S. Cl. ..... 102/517; 102/518

[58] Field of Search ..... 102/517, 518, 519, 501

[56] References Cited

U.S. PATENT DOCUMENTS

| | | | |
|---|---|---|---|
| H343 | 10/1987 | Keown et al. | 102/517 |
| H382 | 12/1987 | Keown et al. | 102/517 |
| 4,123,975 | 11/1978 | Mohaupt | 102/518 |
| 4,463,678 | 8/1984 | Weimer et al. | 102/307 |

*Primary Examiner*—David H. Brown

*Attorney, Agent, or Firm*—Saul Elbaum; Guy M. Miller; Thomas E. McDonald

[57] ABSTRACT

A composite long rod penetrator formed from depleted uranium and titanium has a longitudinal hardness gradient created by reinforcing the long rod with tungsten wire filaments. The longitudinal hardness gradient increases in hardness from a minimum value at the forward ogive end to a maximum value at the aft end. The longitudinal hardness gradient causes the long rod penetrator to exhibit optimum initial penetrating capabilities at high impact velocities and then after impact and some erosion exhibits superior penetrating capabilites at lesser velocities.

13 Claims, 4 Drawing Sheets

COMPOSITE LONG ROD PENETRATOR

RIGHTS OF THE GOVERNMENT

The invention described herein may be manufactured, used and licensed by or for the United States Government for Governmental purposes without payment to me of any royalty thereon.

BACKGROUND OF THE INVENTION

1. Field of the Invention

The present invention relates to long rod penetrators and more particularly to composite long rod penetrators that have longitudinal hardness gradients.

2. Description of the Prior Art

Prior art long rod penetrators for defeating armored targets have consisted of metal matrix composite and monolithic designs. Development work on matrix composite long rod penetrators has been ongoing for a number of years. However, the work on composites as well as monolithic penetrators, reported by various investigators, has based the evaluation of the penetrator's materials on a misleading assumption. Investigators have been evaluating different materials to determine penetrator effectiveness based on the striking velocity required to defeat a target. Consequently, results of tests will show that the striking velocity limit for the composite and the monolithic penetrators are similar at each hardness. The problem with this evaluation procedure is that it doesn't take into consideration the effectiveness of these penetrators after they pass though a target. This characteristic is particularly important when evaluating penetrator effectiveness against multilayered targets. When the progress of the penetrators through various targets is considered, it can be shown that at the initial high velocities certain materials are better than others. Moreover, as the velocity of the penetrators is lost during progress through the targets, material with the best initial penetration is inferior at reduced velocity during later stages of progress. Consequently, long rod penetrators require a combination of unique properties in order to increase their effectiveness. This combination of properties is not found in present homogeneous monolithic or composite long rod penetrators.

SUMMARY OF THE INVENTION

It is therefore an object of the invention to provide a long rod penetrator that has enhanced penetrating capabilities.

It is a further object of the present invention to provide a long rod penetrator that takes advantage of those materials that perform best at their respective velocities at impact on a multiple layered target.

In accordance with the invention, a long rod penetrator that has enhanced penetrating capabilities, especially against multiple layered targets, works on the principle of having a relatively soft front or ogive end with progressively harder material towards the aft end. One means of accomplishing this principle is through the use of a longitudinal hardness gradient extending from the front end having a minimum value hardness to the aft end having a maximum value hardness. An embodiment for accomplishing this principle comprises a long rod penetrator formed from depleted uranium (DU) and ¾% titanium (¾% Ti) and reinforcing tungsten (W) wire filaments that increase in volume percent towards the aft end of the penetrator.

The above and other objects, features, and advantages of the present invention will be better understood from the following detailed description taken in conjunction with the accompanying drawings.

BRIEF DESCRIPTION OF THE DRAWINGS

FIG. 7 shows a graph of Loss of Velocity vs. Striking Velocity for comparing long rod penetrators of tungsten alloy composite design to those of depleted uranium.

DESCRIPTION OF THE PREFERRED EMBODIMENTS

Figure 1:
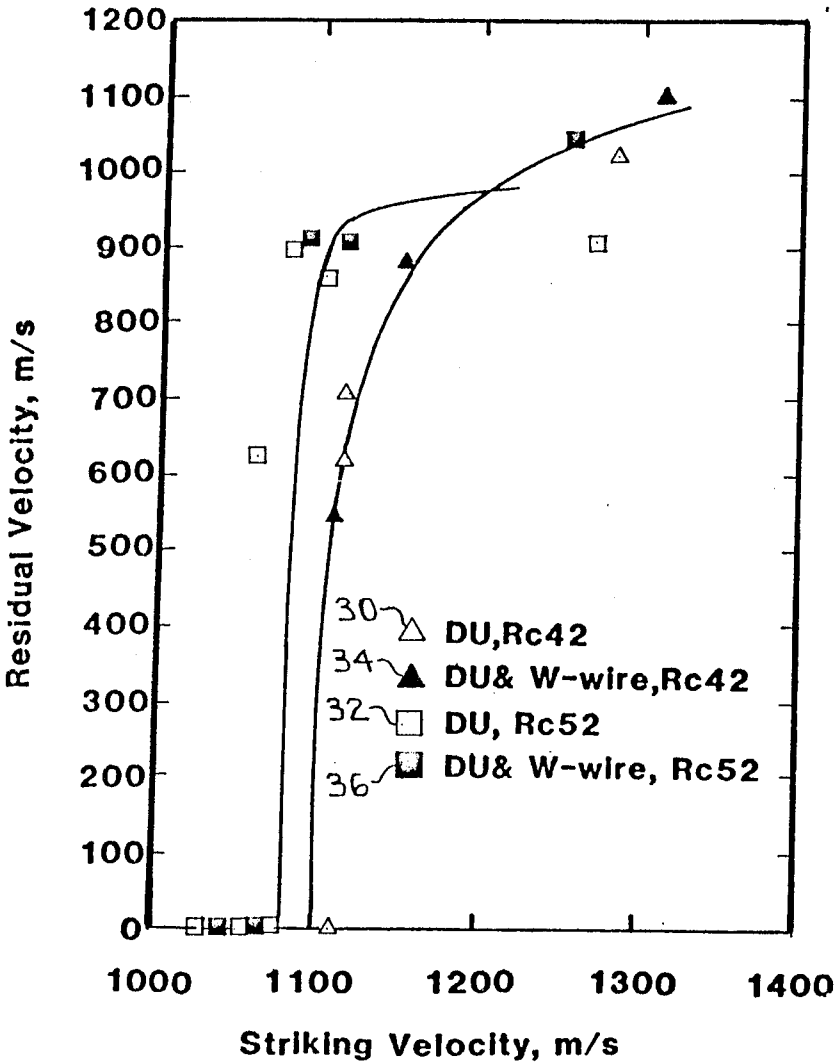
FIG. 1 shows a graph of Residual Velocity vs. Striking Velocity for various long rod penetrators against an oblique triple plate target.

FIG. 1 shows test data on penetrator effectiveness for different long rod penetrators impacting at an obliquity of 75° against a triple plate target. Long rod penetrators having a length to diameter ratio of 20 were used. The residual velocity of the penetrators after they exited the third plate was compared with the striking velocity (Vs) of the penetrators upon the first plate. Values shown are in meters per second. Measuring the effectiveness of different materials in long rod penetrators against targets has long been determined by analyzing the striking velocity, (Vs), required to defeat a target. The striking velocity must surpass a minimum limit velocity in order for the penetrator to penetrate completely through a target. The limit velocity is that velocity at which the long rod penetrators can no longer penetrate through the target or, in other words, is that velocity at which the penetrators have no residual velocity left after impact. As seen in FIG. 1 the limit velocity appears to be around 1075 m/s as those penetrators with a slower striking velocity did not make it though the last plate of the target. Beyond this limit velocity a comparison of different material compositions can be made.

Test data was gathered on both monolithic and composite long rod penetrators against a triple plate target. As can be seen from the data in FIG. 1, it appears that the monolithic long rod penetrators 30 and 32 and the composite penetrators 34 and 36 exhibited similar results at comparative Rockwell hardnesses. That is, a monolithic long rod penetrator of depleted uranium and titanium (DU ¾% Ti) with a "Rockwell C 42" hardness (Rc42), 30, and a composite long rod penetrator of depleted uranium and titanium with 45% by volume tungsten wire filaments (DU ¾% Ti & 45% W-wire) with a "Rockwell C 42" hardness (Rc42), 34, each exhibited similar results. Similarly, a monolithic long rod penetrator of DU ¾% Ti with a hardness of Rc52, 32, and a composite long rod penetrator of DU ¾% Ti &

45% W-wire with a hardness of Rc52, 36, also exhibit similar results. Consequently, it might be concluded from this comparative analysis that the DU ¾% Ti in the fully aged condition (i.e., Rockwell C 52) is an improvement over the standard material and that the tungsten wire reinforcement has no effect on the ballistic behavior of the DU ¾% Ti against a triple target. However, this conclusion is not accurate when the progress of the long rod penetrators through multiple layers is considered.

Figure 2:
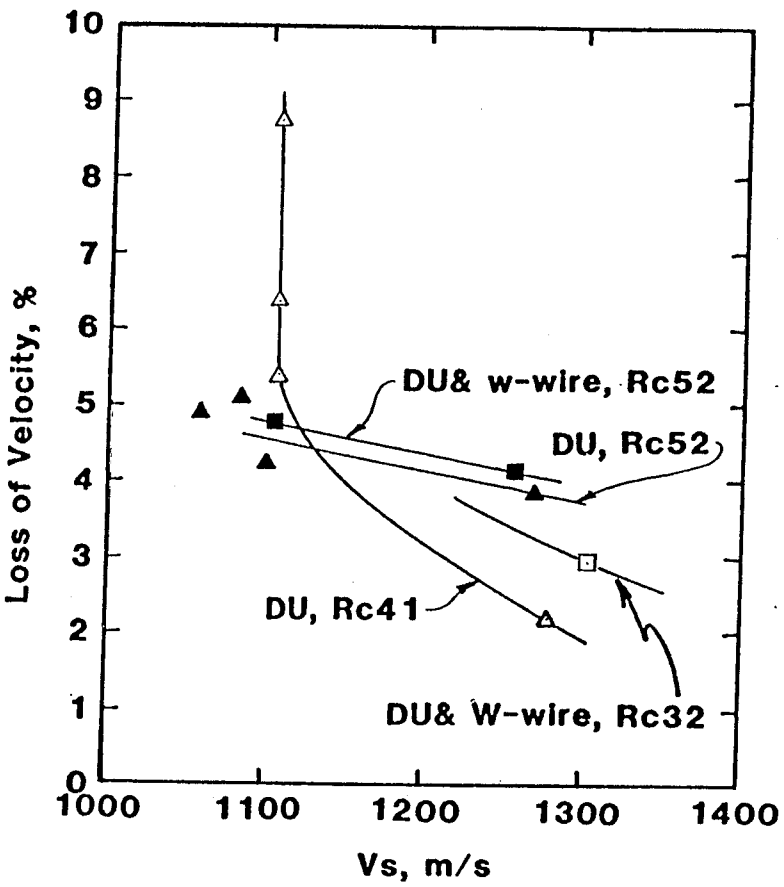
FIG. 2 shows a graph of Loss of Velocity vs. Striking Velocity for various long rod penetrators through the first two plates of a triple target.
Figure 3:
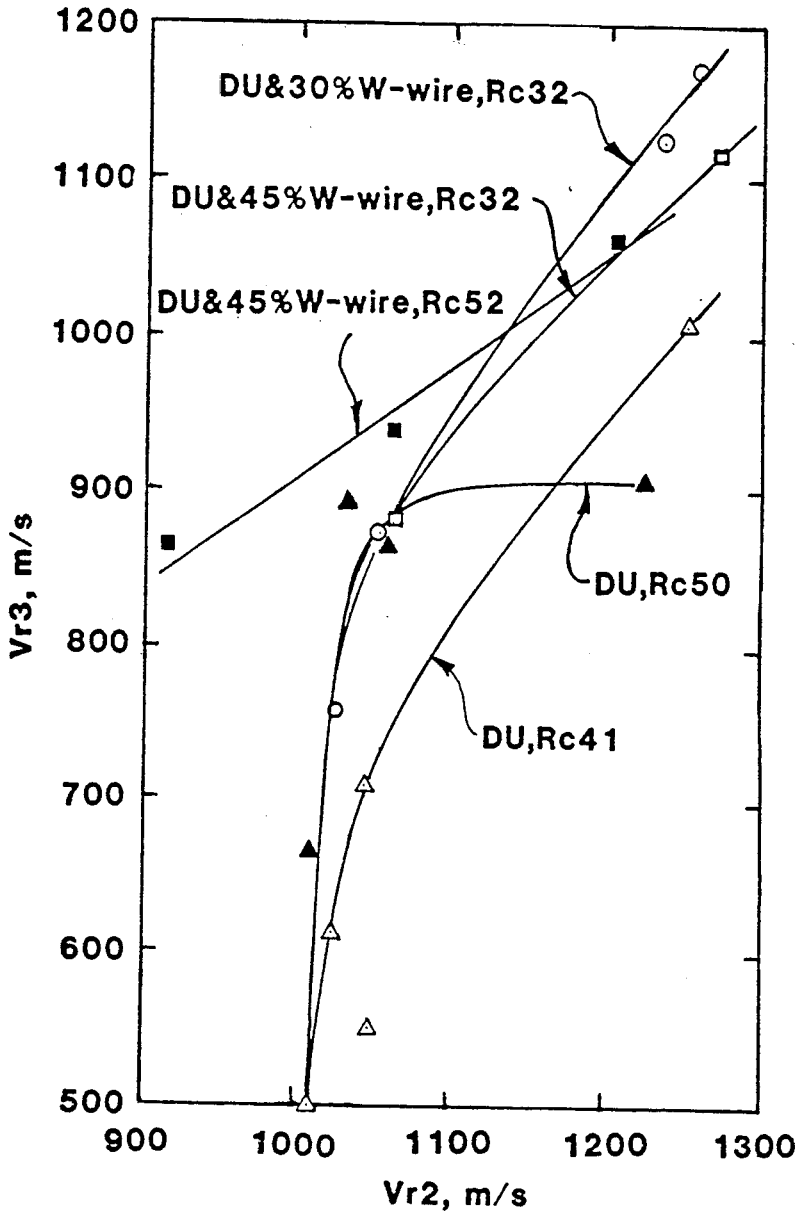
FIG. 3 shows a graph of Penetrating Velocity (Plate 3) vs. Penetrating Velocity (Plate 2) for various long rod penetrators through a triple plate target.

Penetrator materials that perform best at high initial velocities are not the best at reduced velocities. In FIG. 2, for example, when the percent loss of velocity through the first two plates of an oblique triple target is compared with the initial striking velocity of various long rod penetrators it can be seen that the least loss of velocity occurs with a monolithic penetrator of DU ¾% Ti with a Rockwell hardness of Rc41 between 1100 m/s and 1300 m/s. The greatest loss in velocity, at 1300 m/s, occurs with a composite penetrator of DU ¾% Ti & 45% W-wire with an Rc52 hardness rating. In contrast, this reinforced long rod penetrator of DU ¾% Ti & 45% W-wire with an Rc52 hardness, performed best at the reduced velocities during penetration of the third plate. See FIG. 3. For example, even though the reinforced long rod penetrator of DU ¾% Ti & 45% W-wire with an Rc52 rating exits the second plate with the slowest velocity (Vr2) of only about 900 m/s, as compared with the monolithic penetrators, it exhibits an exit velocity (Vr3) from the third plate of about 870 m/s, which is faster than the monolithic penetrators.

Figure 4:
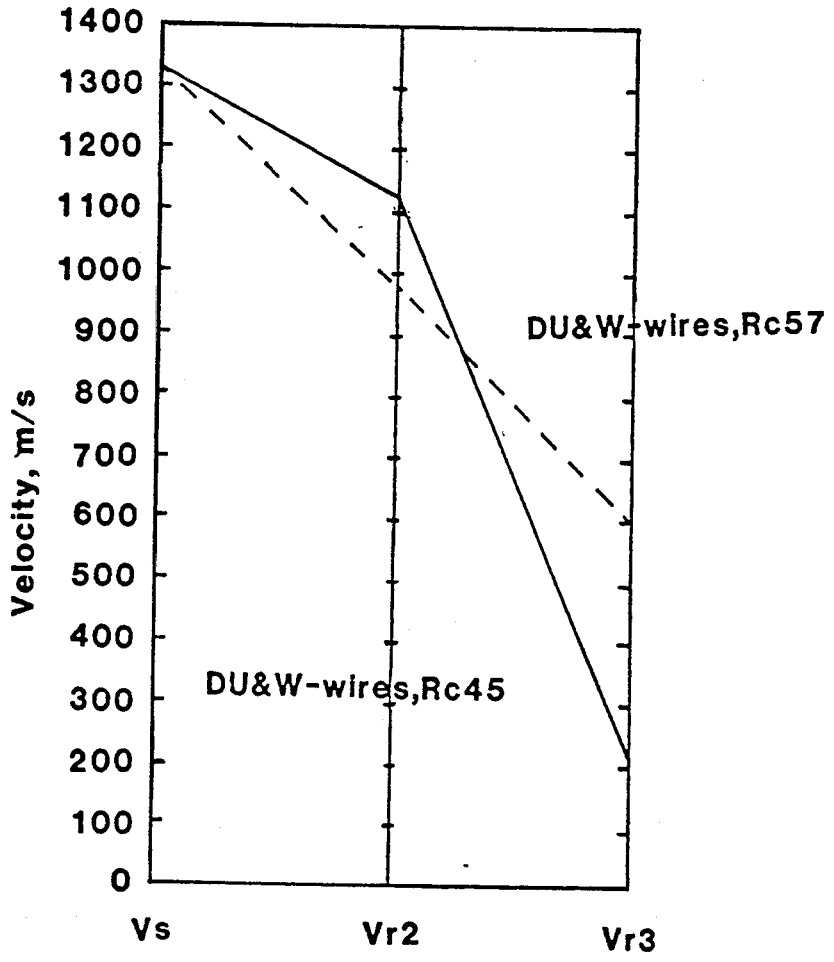
FIG. 4 shows a graph of Penetrating Velocity vs. Target Plate summarizing the results of FIGS. 2 and 3.

FIG. 4 shows in summary fashion that as the Rockwell hardness of the DU ¾% Ti long rod penetrators with tungsten wire reinforcing is increased the loss of velocity through plates one and two increases, but penetration at reduced velocity, through plate 3, improves. The data in FIG. 4 was obtained at 70.5° obliquity where it was observed that through the first two plates the penetrator with an Rc57 hardness lost 27% of its velocity whereas, the penetrator with an Rc45 hardness lost only 15% of its velocity. Although the penetrator with an Rc57 hardness exited the second plate with the lowest velocity (Vr2), it defeated the third plate with more than double the residual velocity (Vr3) of the Rc45 material.

It can therefore be concluded from the results shown in these proceeding graphs that an improved long rod penetrator can be made that comprises a standard "soft" DU ¾% Ti front end with a "harder" reinforced aft end. One means by which this may be accomplished is by providing a longitudinal hardness gradient formed from wire reinforcing material. The hardness gradient would extend from a minimum value at the front end of the penetrator to a maximum value ending at the aft end of the penetrator. Thus, at high initial penetrator velocities the superior performance of the soft DU ¾% Ti would be utilized. Then, as the penetrator travels through the target, eroding material and losing velocity, the reinforced material that is better suited for low velocity penetration is exposed. That is, the hard material that performs poorly at high velocities would not be exposed at high initial velocities, but it would be held in reserve until the velocity of the penetrator is reduced.

Figure 5:
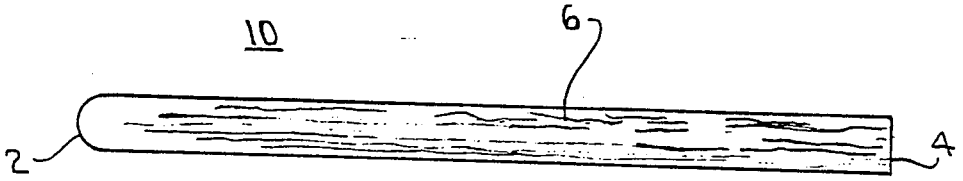
FIG. 5 shows a longitudinal sectional view of a long rod penetrator according to an embodiment of the present invention.

FIG. 5 shows an embodiment of the present invention that takes advantage of the best features of each material. A sectional view of a composite long rod penetrator 10 is shown having a forward ogive end 2 and an aft end 4. A variety of materials may be used for the long rod such as aluminum, copper, steel or depleted uranium. The preferred material is an alloy of depleted uranium and ¾% titanium (DU ¾% Ti). The long rod penetrator 10 is unidirectionally reinforced with a plurality of filaments 6. The filaments 6 may be tungsten or any suitable reinforcing material. The filaments 6 are embedded within the depleted uranium long rod so that they form a longitudinal hardness gradient that increases in hardness from the forward ogive end 2 to the aft end 4. The percent volume reinforcement of tungsten can range from about 25% to 50% at the aft end. However, a gradient to 30% volume is preferred due to its superior performance over the range of about 1150m/s to 1250 m/s as previously shown in FIG. 3.

Figure 6:
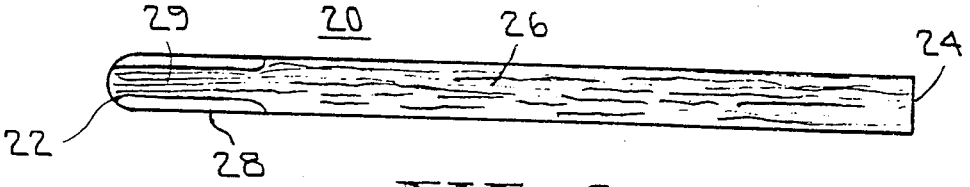
FIG. 6 shows a longitudinal sectional view of a long rod penetrator according to another embodiment of the present invention.
Figure 1:
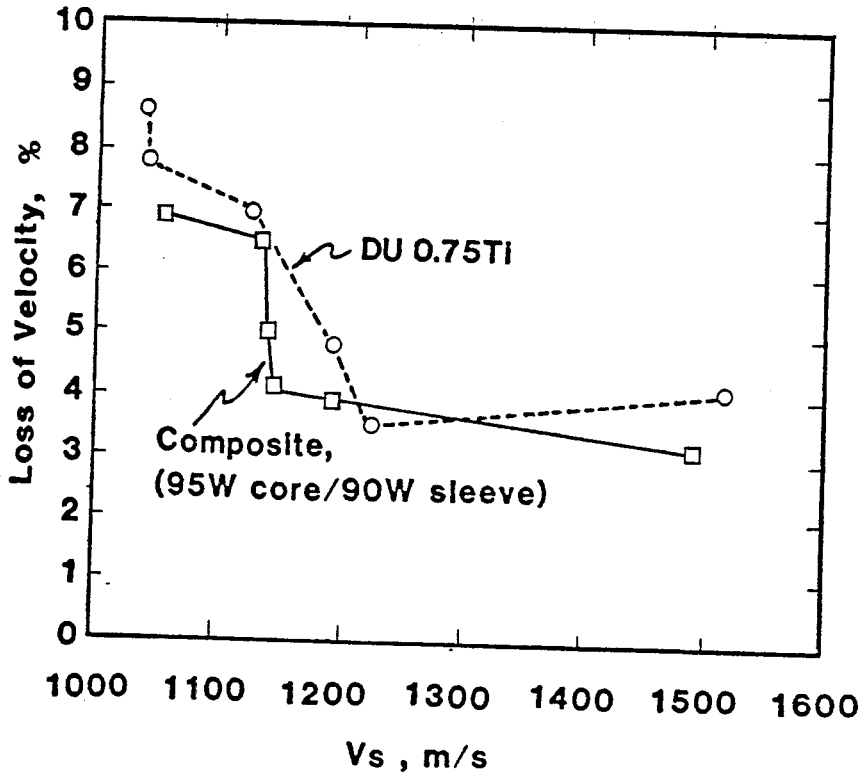

FIG. 6 shows a sectional view of another embodiment of a composite long rod penetrator 20 having a forward ogive and 22 and an aft end 24. The long rod penetrator 20 is unidirectionally reinforced with a plurality of filaments 26. A "soft" cylindrical sleeve 28 uniformly covers a forward core 29 of suitably hardened and reinforced DU ¾% Ti material. The cylindrical sleeve 28 may be of any suitable material such as tungsten alloy.

Having a DU ¾% Ti front ogive end should also prove beneficial in that this material has a low sonic velocity; so, the effects of impact on the reinforced back-end would be reduced at the high initial velocities. The sonic wave might not reach the reinforced material until the DU front has eroded which would tend to soften the blow. Additionally, this configuration would be beneficial against advanced armor materials with high hardness.

The concept of forming a longitudinal hardness gradient in a composite penetrator may also be employed using other materials other than the DU ¾% Ti and tungsten wire filament as set forth above. FIG. 7 shows that a tungsten alloy composite can be designed to behave much like the DU ¾% Ti material against the first and second plates of a triple target. Note that both materials have low velocity losses at the high striking velocities, and both have high losses at the low near-limit velocities. Either material might be utilized at the front end of a penetrator while a properly designed material would follow for enhanced penetration at the reduced velocities encountered after the initial slowdown. That is, after the erosion of the front-end material, a harder material would become exposed for superior penetration characteristics at the reduced velocity.

It will be apparent that the embodiments shown are only exemplary and that various modifications can be made in connection and arrangement within the scope of the invention.

What is claimed is:

1. A composite long rod penetrator comprising:

a long rod having a forward ogive end and an aft end, said long rod formed of a metal composite material and a plurality of reinforcing filaments, said reinforcing filaments disposed throughout said long rod increasing in volume percent from the forward ogive end towards the aft end for creating a longitudinal hardness gradient in said long rod that increases in hardness from a minimum value at the forward ogive end to a maximum value at the aft end.

2. The composite long rod penetrator of claim 1 wherein;

said metal composite material is selected from the group consisting of aluminum, copper, steel or depleted uranium.

3. The composite long rod penetrator of claim 1 wherein;

said reinforcing filaments are comprised of tungsten.

4. The composite long rod penetrator of claim 1 wherein;

said reinforcing filaments comprise about 25 to 50 percent by volume of the aft end of said long rod.

5. A composite long rod penetrator comprising:

a long rod having a forward ogive end and an aft end, said long rod formed of a metal composite material unidirectionally reinforced with a plurality of tungsten wire filaments increasing in volume percent from the forward ogive end towards the aft end, said tungsten wire filaments creating a longitudinal hardness gradient in said long rod that increases in hardness from the forward ogive end to the aft end in which the aft end has a tungsten wire volume percent ranging from about 25 to 50 percent, whereby the longitudinal hardness gradient of said long rod allows optimum initial penetrating capabilities at high striking velocities and then after impact and some erosion exposes more tungsten wire filaments for superior penetration at lesser velocities.

6. The composite long rod penetrator of claim 5 wherein;

said metal composite material is comprised of a material of which one component is selected from the group consisting of aluminum, copper, steel or depleted uranium.

7. The composite long rod penetrator of claim 5 wherein;

said metal composite material consists of depleted uranium and ¾% titanium.

8. The composite long rod penetrator of claim 5 wherein;

said long rod has a Rockwell hardness ranging from about Rc32 to Rc57.

9. The composite long rod penetrator of claim 5 wherein;

said long rod has a length to diameter ratio of about 20.

10. A composite long rod penetrator comprising:

a long rod having a forward ogive end and an aft end, said long rod formed of a metal composite material unidirectionally reinforced with a plurality of tungsten wire filaments; and a metal sleeve uniformly covering the forward ogive end of said long rod and flush with the surface of said long rod, said metal sleeve having hardness that is less than that of said long rod.

11. The composite long rod penetrator of claim 10 wherein;

said metal composite material is comprised of a material of which one component is selected from the group consisting of aluminum, copper, steel or depleted uranium.

12. The composite long rod penetrator of claim 10 wherein;

said long rod has a Rockwell hardness ranging from about Rc32 to Rc57.

13. The composite long rod penetrator of claim 10 wherein;

said long rod has a length to diameter ratio of about 20.

* * * * *